US010777079B2

(12) United States Patent
Yuan

(10) Patent No.: US 10,777,079 B2
(45) Date of Patent: Sep. 15, 2020

(54) METHODS AND SYSTEMS FOR ESTIMATING AN END OF A VEHICLE TRIP

(71) Applicant: HONDA MOTOR CO., LTD., Tokyo (JP)

(72) Inventor: Alvin Yuan, Carson, CA (US)

(73) Assignee: HONDA MOTOR CO., LTD., Tokyo (JP)

( * ) Notice: Subject to any disclaimer, the term of this patent is extended or adjusted under 35 U.S.C. 154(b) by 0 days.

(21) Appl. No.: 15/937,334

(22) Filed: Mar. 27, 2018

(65) Prior Publication Data

US 2019/0304304 A1 Oct. 3, 2019

(51) Int. Cl.
*G08G 1/127* (2006.01)
*G07C 5/08* (2006.01)

(52) U.S. Cl.
CPC ..... *G08G 1/127* (2013.01); *G07C 5/085* (2013.01)

(58) Field of Classification Search
CPC ..... G08G 1/127; G07C 5/085
See application file for complete search history.

(56) References Cited

U.S. PATENT DOCUMENTS 6,546,330 B2 4/2003 Fushiki et al.
9,520,006 B1 * 12/2016 Sankovsky ..... G07C 5/006
9,564,048 B2 2/2017 Liu et al.
9,846,977 B1 * 12/2017 Cox ..... G07C 5/02
2016/0341559 A1 * 11/2016 Camisa ..... G01C 21/34
2017/0270790 A1 * 9/2017 Neiger ..... G08G 1/127

OTHER PUBLICATIONS

Cai, Q., "New Calculating Method for HCM 2000 Queue Length Estimation Procedures with the Application of Floating Car Data," Procedia—Social and Behavioral Sciences, 2013, pp. 2201-2210.
Gong, et. al., "Identification of Activity Stop Locations in GPS Trajectories by Density-Based Clustering Method Combined With Support Vector Machines," Journal of Modern Transportation, 23(3), pp. 202-2013, 2015.
Sarvi, M., et al. "A Methodology for Data Cleansing and Trip End Identification of Probe Vehicles," JSCE Conference of Infrastructure Planning, vol. 26, Nov. 2002.

* cited by examiner

*Primary Examiner* — James J Yang
(74) *Attorney, Agent, or Firm* — Arent Fox LLP

(57) ABSTRACT

Systems and methods for estimating an end of a vehicle trip. The system includes a memory that stores instructions for executing processes for estimating the end of the vehicle trip and a processor configured to execute the instructions. The instructions cause the processor to: receive first data from each of a vehicle and a mobile device connected to the vehicle, the first data being received from the vehicle at periodic intervals; receive updated first data and second data from the mobile device when the mobile device is disconnected from the vehicle; upon failing to receive the first data from the vehicle at a next interval, estimate the end of the vehicle trip based on the updated first data and the second data from the mobile device; and generate a trip log with the estimated end of the vehicle trip.

14 Claims, 4 Drawing Sheets

METHODS AND SYSTEMS FOR ESTIMATING AN END OF A VEHICLE TRIP

TECHNICAL FIELD

The present disclosure relates to methods and systems for estimating an end of a vehicle trip.

BACKGROUND

Current systems may monitor a trip of a vehicle and log when a trip begins through data provided by the vehicle. However, these systems may not receive sufficient information to determine when the trip has concluded. As such, these systems merely make assumptions as to when the trip has concluded.

SUMMARY

This summary is provided to introduce a selection of concepts in a simplified form that are further described below in the DETAILED DESCRIPTION. This summary is not intended to identify key features of the claimed subject matter, nor is it intended to be used as an aid in determining the scope of the claimed subject matter.

In one aspect, the present disclosure is related to a system that includes a memory that stores instructions for executing processes for estimating the end of the vehicle trip and a processor configured to execute the instructions. The instructions cause the processor to: receive first data from each of a vehicle and a mobile device connected to the vehicle, the first data being received from the vehicle at periodic intervals; receive updated first data and second data from the mobile device when the mobile device is disconnected from the vehicle; upon failing to receive the first data from the vehicle at a next interval, estimate the end of the vehicle trip based on the updated first data and the second data from the mobile device; and generate a trip log with the estimated end of the vehicle trip.

In a further aspect, the present disclosure is related to a method that includes: receiving first data from each of a vehicle and a mobile device connected to the vehicle, the first data being received from the vehicle at periodic intervals; receiving updated first data and second data from the mobile device when the mobile device is disconnected from the vehicle; upon failing to receive the first data from the vehicle at a next interval, estimating an end of a vehicle trip based on the updated first data and the second data from the mobile device; and generating a trip log with the estimated end of the vehicle trip.

In a further aspect, the present disclosure is related to a non-transitory computer-readable storage medium containing executable computer program code. The code comprises instructions configured to cause a processor to: receive first data from each of a vehicle and a mobile device connected to the vehicle, the first data being received from the vehicle at periodic intervals; receive updated first data and second data from the mobile device when the mobile device is disconnected from the vehicle; upon failing to receive the first data from the vehicle at a next interval, estimate an end of a vehicle trip based on the updated first data and the second data from the mobile device; and generate a trip log with the estimated end of the vehicle trip.

BRIEF DESCRIPTION OF THE DRAWINGS

The novel features believed to be characteristic of aspects of the disclosure are set forth in the appended claims. In the descriptions that follow, like parts are marked throughout the specification and drawings with the same numerals, respectively. The drawing figures are not necessarily drawn to scale and certain figures may be shown in exaggerated or generalized form in the interest of clarity and conciseness. The disclosure itself, however, as well as a preferred mode of use, further objects and advances thereof, will be best understood by reference to the following detailed description of illustrative aspects of the disclosure when read in conjunction with the accompanying drawings, wherein:

DETAILED DESCRIPTION

The following includes definitions of selected terms employed herein. The definitions include various examples and/or forms of components that fall within the scope of a term and that may be used for implementation. The examples are not intended to be limiting.

A "processor," as used herein, processes signals and performs general computing and arithmetic functions. Signals processed by the processor may include digital signals, data signals, computer instructions, processor instructions, messages, a bit, a bit stream, or other computing that may be received, transmitted and/or detected.

A "bus," as used herein, refers to an interconnected architecture that is operably connected to transfer data between computer components within a singular or multiple systems. The bus may be a memory bus, a memory controller, a peripheral bus, an external bus, a crossbar switch, and/or a local bus, among others. The bus may also be a vehicle bus that interconnects components inside a vehicle using protocols, such as Controller Area network (CAN), Local Interconnect Network (LIN), among others.

A "memory," as used herein may include volatile memory and/or non-volatile memory. Non-volatile memory may include, for example, ROM (read only memory), PROM (programmable read only memory), EPROM (erasable PROM) and EEPROM (electrically erasable PROM). Volatile memory may include, for example, RAM (random access memory), synchronous RAM (SRAM), dynamic RAM (DRAM), synchronous DRAM (SDRAM), double data rate SDRAM (DDR SDRAM), and/or direct RAM bus RAM (DRRAM).

An "operable connection," as used herein may include a connection by which entities are "operably connected," is one in which signals, physical communications, and/or logical communications may be sent and/or received. An operable connection may include a physical interface, a data interface and/or an electrical interface.

A "vehicle," as used herein, refers to any moving vehicle that is powered by any form of energy. A vehicle may carry human occupants or cargo. The term "vehicle" includes, but is not limited to: cars, trucks, vans, minivans, SUVs, motorcycles, scooters, boats, personal watercraft, and aircraft. In some cases, a motor vehicle includes one or more engines.

Figure 1:
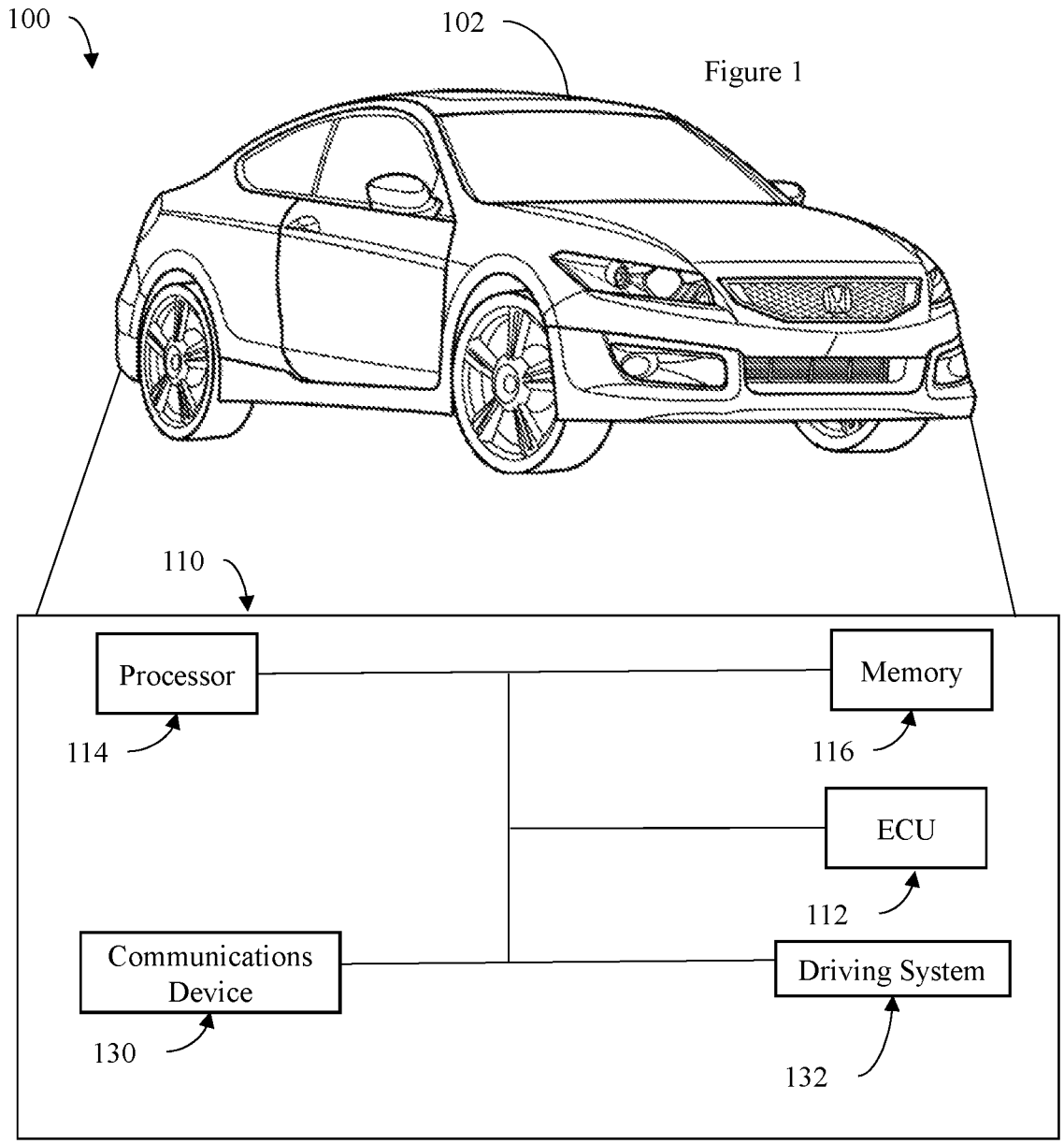
FIG. 1 illustrates a schematic view of an exemplary operating environment of a vehicle system in accordance with aspects of the present disclosure.

Generally described, the present disclosure provides systems and methods for estimating an end of a vehicle trip. Turning to FIG. 1, a schematic view of an exemplary operating environment 100 of a vehicle system 110 according to an aspect of the disclosure is provided. The vehicle system 110 may reside within a vehicle 102. The components of the vehicle system 110, as well as the components of other systems, hardware architectures, and software architectures discussed herein, may be combined, omitted or organized into various implementations.

The vehicle 102 may generally include an electronic control unit (ECU) 112 that operably controls a plurality of vehicle systems. The ECU 112 may include internal processing memory, an interface circuit, and bus lines for transferring data, sending commands, and communicating with the vehicle systems. The ECU 112 may include an internal processor and memory, not shown. The vehicle 102 may also include a bus for sending data internally among the various components of the vehicle system 110. The vehicle systems may include, but are not limited to, the vehicle system 110, among others, including vehicle HVAC systems, vehicle audio systems, vehicle video systems, vehicle infotainment systems, vehicle telephone systems, and the like.

The vehicle system 110 may also include a processor 114 and a memory 116 that communicate with a communications device 130 and driving system 132. In some aspects, the driving system 132 may collect floating car data/floating cellular data ("FCD"). In some aspects, the FCD may include, but is not limited to, localization data, speed, direction of travel, and time information of the vehicle 102. In some aspects, the FCD, along with other data, may be used to determine when a vehicle trip has concluded. The communications device 130 (e.g., wireless modem) may provide wired or wireless computer communications utilizing various protocols to send/receive electronic signals internally with respect to features and systems within the vehicle 102 and with respect to external devices. These protocols may include a wireless system utilizing radio-frequency (RF) communications (e.g., IEEE 802.11 (Wi-Fi), IEEE 802.15.1 (Bluetooth®)), a near field communication system (NFC) (e.g., ISO 13157), a local area network (LAN), a wireless wide area network (WWAN) (e.g., cellular) and/or a point-to-point system. Additionally, the communications device 130 of the vehicle 102 may be operably connected for internal computer communication via a bus (e.g., a CAN or a LIN protocol bus) to facilitate data input and output between the electronic control unit 112 and vehicle features and systems. In an aspect, the communications device 130 may be configured for vehicle-to-vehicle (V2V) communications, vehicle-to-pedestrian (V2P) communications, and/or vehicle-to-anything (V2X) communications. For example, V2V, V2P, and V2X communications may include wireless communications over a reserved frequency spectrum. As another example, V2V, V2P, and V2X communications may include an ad hoc network between vehicles set up using Wi-Fi or Bluetooth®. In some aspects, the driving system 132 may transmit the FCD directly to a manufacturer system, such as a server, using the communications device 130. For example, the FCD may be transmitted to the manufacturer system upon start-up of the vehicle and at scheduled intervals, e.g., every ten minutes, throughout a duration of the vehicle trip. In further aspects, the driving system 132 may also transmit the FCD to a mobile device coupled to the vehicle using, for example, a Wi-Fi or Bluetooth® connection, such that the coupled mobile device may also transmit the FCD to the manufacturer system.

Figure 2:
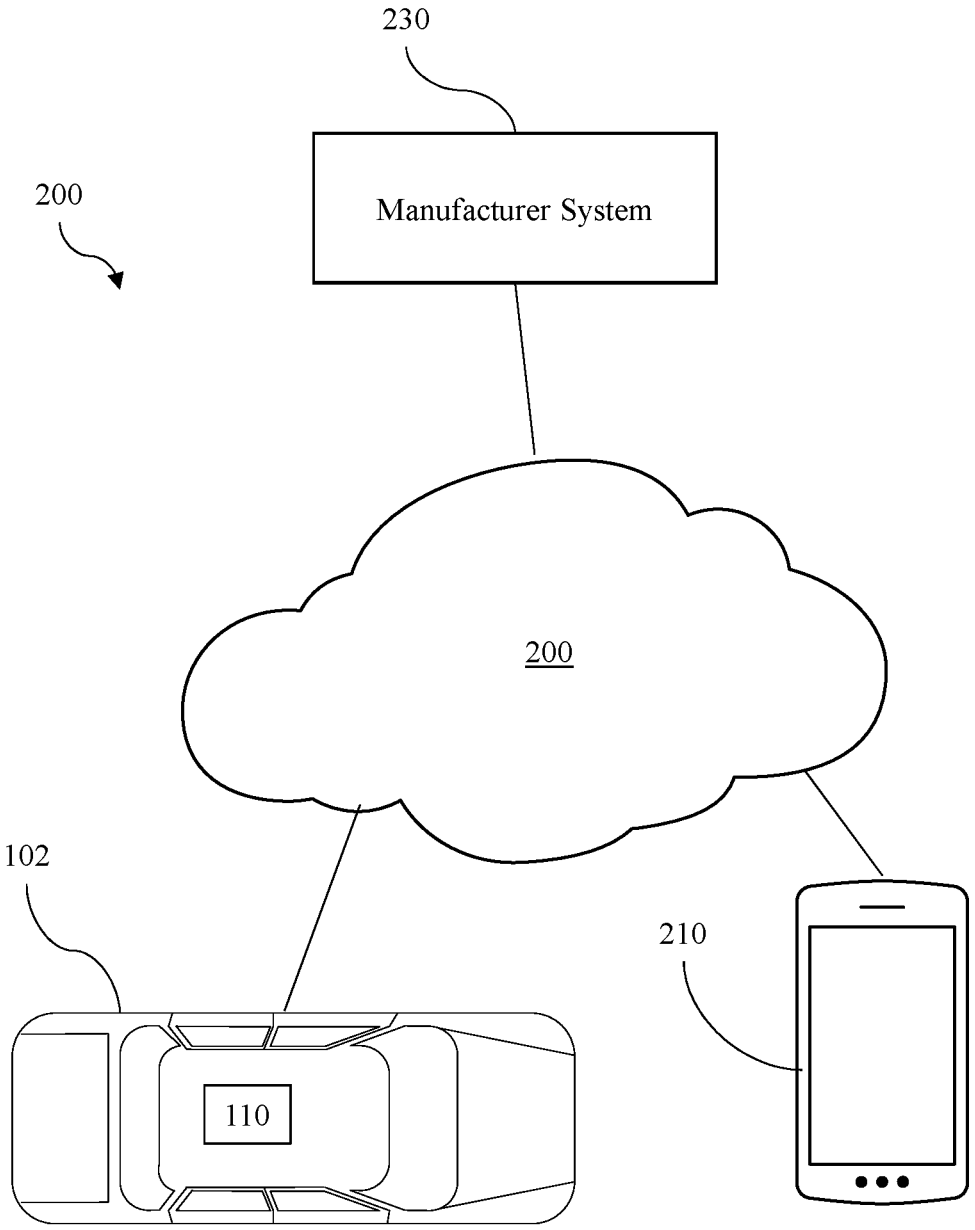
FIG. 2 illustrates an exemplary network for managing the vehicle system.

FIG. 2 illustrates an exemplary network 200 for managing the vehicle system 110. The network 200 may be a communications network that facilitates communications between multiple systems. For example, the network 200 may include the Internet or another Internet Protocol (IP) based network. The network 200 may enable the vehicle system 110 to communicate with a mobile device 210 or a manufacturer system 230. The manufacturer system 230, mobile device 210, and driving system 132 may include a computer system, as shown with respect to FIG. 3 described below. For example, the manufacturer system 230 may also include a memory that stores instructions for executing processes for estimating when the vehicle trip concluded based on the FCD and other information, and a processor configured to execute the instructions.

In some aspects, the vehicle system 110 may, for example, transmit the FCD to the manufacturer system 230 via the network 200. In some aspects, the FCD may be transmitted from the vehicle system 110 to the manufacturer system 230 upon starting the vehicle 102 and at scheduled intervals, e.g., every ten minutes, throughout a duration of the vehicle trip. In further aspects, the vehicle system 110 may transmit the FCD directly to the manufacturer system 230 using the communications device 130. In further aspects, the vehicle system 110 may transmit the FCD to the mobile device 210, which may be coupled to the vehicle 102 using a Wi-Fi or Bluetooth® connection, and the mobile device 210 may, in turn, transmit the FCD to the manufacturer system 230. In some aspects, a connection between the mobile device 210 and the vehicle 102 may be monitored using an application operating on the mobile device 210 and/or the vehicle 102.

In some aspects, the manufacturer system 230 may estimate when a driving trip concluded based on the FCD. In some aspects, when the vehicle 102 stops transmitting the FCD, it is indicative that the trip has concluded. However, the manufacturer system 230 may not be aware of when the trip concluded in between transmission intervals of the FCD. To resolve this, when the mobile device 210 is disconnected from the vehicle 102, the mobile device 210 may transmit the most recent FCD, as well as other information, such as the speed of the vehicle 102, the time of day, a current location of the vehicle 102, whether media was being streamed in the vehicle 102 (e.g., music), a navigation setting, etc. In some aspects, the disconnection between the mobile device 210 and the vehicle 102 may be detected when the wireless connection, e.g., a Wi-Fi or Bluetooth® connection, between the mobile device 210 and the vehicle 102 is terminated. Thus, when the manufacturer system 230 fails to receive the FCD at a next scheduled interval, the manufacturer system 230 may estimate when the trip concluded based the FCD and other information received from the mobile device 210. For example, when the mobile device 210 is disconnected from the vehicle 102 while the vehicle 102 is still in motion but nearing its destination, the manufacturer system 230 may estimate when the trip concluded by estimating a remaining travel time based on the information from the mobile device 210. As another example, when the mobile device 210 is disconnected from vehicle 102 while the vehicle 102 is stationary, the manufacturer system 230 may estimate the end of the vehicle trip by estimating a time of arrival as the end of the vehicle trip based on the time the disconnect occurs. In some aspects, the manufacturer system 230 may generate a trip log with the estimated end of the trip.

In some aspects, the manufacturer system 230 may store the estimated arrival time as the end of a trip until the FCD is received from the vehicle 102, e.g., upon the next start-up of the vehicle 102. Upon receiving the FCD from the vehicle 102 upon start-up, the manufacture system 230 may replace the estimated end to the trip with the FCD from the vehicle 102. In some aspects, upon receiving the updated FCD from the vehicle 102, the manufacturer system 230 may generate an updated trip log indicating an actual end time of the trip.

Figure 3:
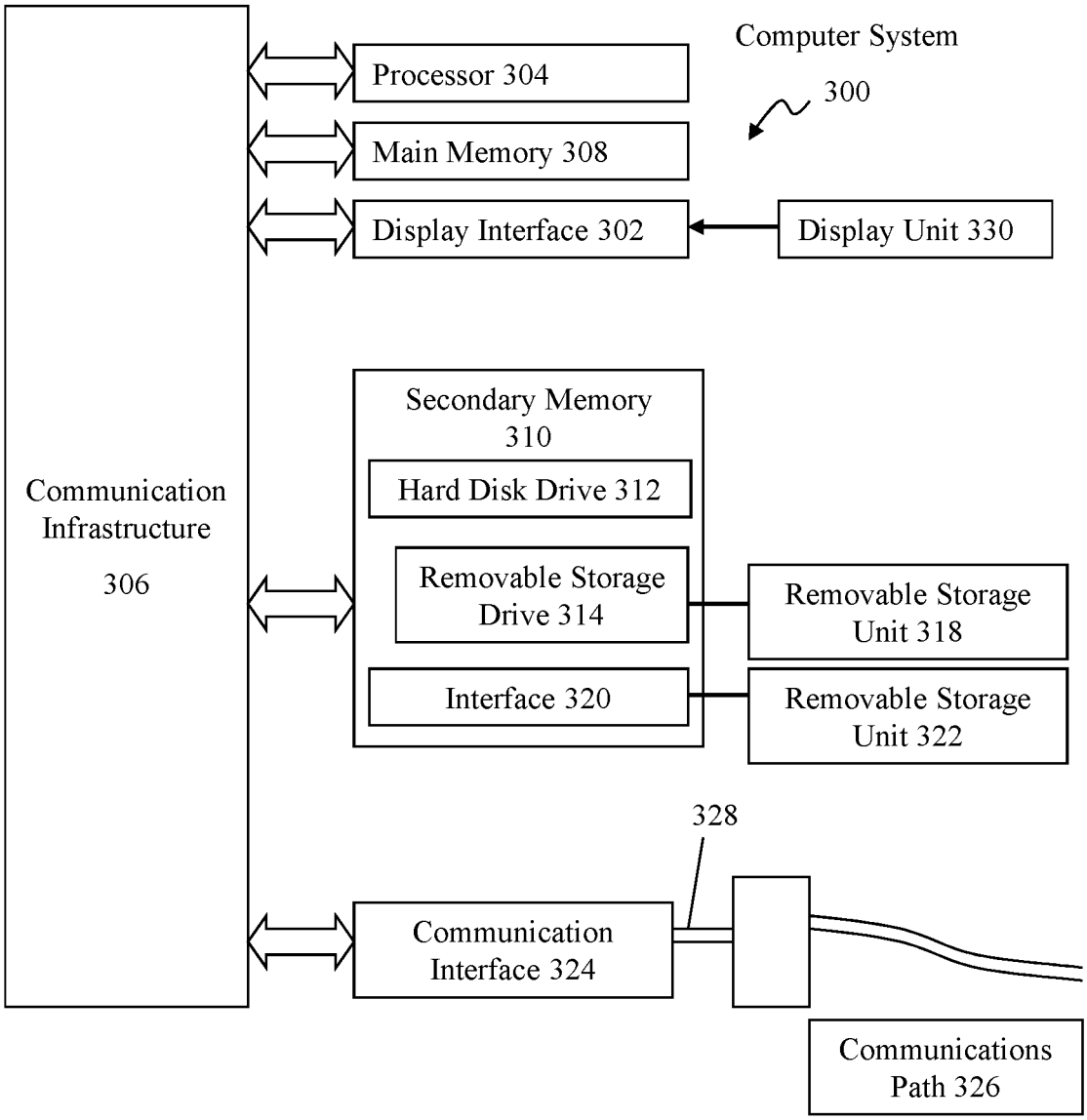
FIG. 3 illustrates various features of an exemplary computer system for use in conjunction with aspects of the present disclosure.

Aspects of the present disclosure may be implemented using hardware, software, or a combination thereof and may be implemented in one or more computer systems or other processing systems. In an aspect of the present disclosure, features are directed toward one or more computer systems capable of carrying out the functionality described herein. An example of such a computer system 300 is shown in FIG. 3.

Computer system 300 includes one or more processors, such as processor 304. The processor 304 is connected to a communication infrastructure 306 (e.g., a communications bus, cross-over bar, or network). Various software aspects are described in terms of this example computer system. After reading this description, it will become apparent to a person skilled in the relevant art(s) how to implement aspects of the disclosure using other computer systems and/or architectures.

Computer system 300 may include a display interface 302 that forwards graphics, text, and other data from the communication infrastructure 306 (or from a frame buffer not shown) for display on a display unit 330. Computer system 300 also includes a main memory 308, preferably random access memory (RAM), and may also include a secondary memory 310. The secondary memory 310 may include, for example, a hard disk drive 312, and/or a removable storage drive 314, representing a floppy disk drive, a magnetic tape drive, an optical disk drive, a universal serial bus (USB) flash drive, etc. The removable storage drive 314 reads from and/or writes to a removable storage unit 318 in a well-known manner. Removable storage unit 318 represents a floppy disk, magnetic tape, optical disk, USB flash drive etc., which is read by and written to removable storage drive 314. As will be appreciated, the removable storage unit 318 includes a computer usable storage medium having stored therein computer software and/or data.

Alternative aspects of the present disclosure may include secondary memory 310 and may include other similar devices for allowing computer programs or other instructions to be loaded into computer system 300. Such devices may include, for example, a removable storage unit 322 and an interface 320. Examples of such may include a program cartridge and cartridge interface (such as that found in video game devices), a removable memory chip (such as an erasable programmable read only memory (EPROM), or programmable read only memory (PROM)) and associated socket, and other removable storage units 322 and interfaces 320, which allow software and data to be transferred from the removable storage unit 322 to computer system 300.

Computer system 300 may also include a communications interface 324. Communications interface 324 allows software and data to be transferred between computer system 300 and external devices. Examples of communications interface 324 may include a modem, a network interface (such as an Ethernet card), a communications port, a Personal Computer Memory Card International Association (PCMCIA) slot and card, etc. Software and data transferred via communications interface 324 are in the form of signals 328, which may be electronic, electromagnetic, optical or other signals capable of being received by communications interface 324. These signals 328 are provided to communications interface 324 via a communications path (e.g., channel) 326. This path 326 carries signals 328 and may be implemented using wire or cable, fiber optics, a telephone line, a cellular link, a radio frequency (RF) link and/or other communications channels. In this document, the terms "computer program medium" and "computer usable medium" are used to refer generally to media such as a removable storage drive 318, a hard disk installed in hard disk drive 312, and signals 328. These computer program products provide software to the computer system 300. Aspects of the present disclosure are directed to such computer program products.

Computer programs (also referred to as computer control logic) are stored in main memory 308 and/or secondary memory 310. Computer programs may also be received via communications interface 324. Such computer programs, when executed, enable the computer system 300 to perform the features in accordance with aspects of the present disclosure, as discussed herein. In particular, the computer programs, when executed, enable the processor 304 to perform the features in accordance with aspects of the present disclosure. Accordingly, such computer programs represent controllers of the computer system 300.

In an aspect of the present disclosure where the disclosure is implemented using software, the software may be stored in a computer program product and loaded into computer system 300 using removable storage drive 314, hard drive 312, or communications interface 320. The control logic (software), when executed by the processor 304, causes the processor 304 to perform the functions described herein. In another aspect of the present disclosure, the system is implemented primarily in hardware using, for example, hardware components, such as application specific integrated circuits (ASICs). Implementation of the hardware state machine so as to perform the functions described herein will be apparent to persons skilled in the relevant art(s).

Figure 4:
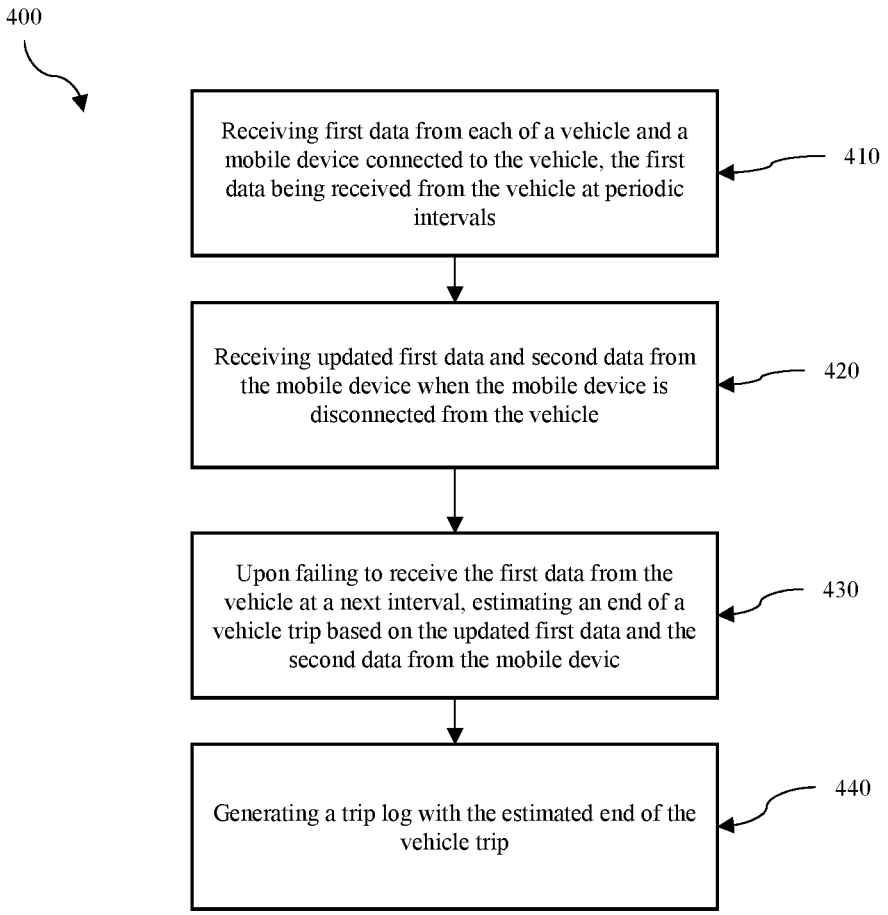
FIG. 4 illustrates an exemplary flowchart for estimating an end of a vehicle trip, according to aspects of the present disclosure.

FIG. 4 illustrates a flowchart for estimating an end of a vehicle trip, according to aspects of the present disclosure. A method 400 includes receiving first data from each of a vehicle and a mobile device connected to the vehicle, the first data being received from the vehicle at periodic intervals 410. In some aspects, the first data may include FCD and the second data may include a current location of the vehicle, whether media was being streamed in the vehicle 102, a navigation setting, etc. In further aspects, the first data may be received from the vehicle every ten minutes, although other intervals are also contemplated according to aspects of the present disclosure. The method also includes receiving updated first data and second data from the mobile device when the mobile device is disconnected from the vehicle 420. In some aspects, the disconnection between the mobile device and the vehicle may be detected when the wireless connection, e.g., a Wi-Fi or Bluetooth® connection, between the mobile device and the vehicle is terminated. The method further includes, upon failing to receive the first data from the vehicle at a next interval, estimating an end of a vehicle trip based on the updated first data and the second data from the mobile device 430 and generating a trip log with the estimated end of the vehicle trip 440. For example, when the mobile device is disconnected from the vehicle while the vehicle is still in motion but nearing its destination, estimating the end of the vehicle trip may include estimating a remaining travel time based on the second data from the mobile device. As another example, when the mobile device is disconnected from the vehicle while the vehicle is stationary, estimating the end of the vehicle trip may include estimating a time of arrival as the end of the vehicle trip based on the time the disconnect occurs.

It will be appreciated that various implementations of the above-disclosed and other features and functions, or alternatives or varieties thereof, may be desirably combined into many other different systems or applications. Also that various presently unforeseen or unanticipated alternatives, modifications, variations, or improvements therein may be subsequently made by those skilled in the art which are also intended to be encompassed by the following claims.

What is claimed is:

1. A system, comprising:

a memory that stores instructions for executing processes for estimating an end of a vehicle trip of a vehicle; and a processor coupled with the memory and configured to execute the instructions, wherein the processor is communicatively coupled with the vehicle via a first communication link and a mobile device via a second communication link different from the first communication link, wherein the instructions cause the processor to:

receive first data from the vehicle via the first communication link, the first data being received from the vehicle at a first scheduled interval of periodic intervals;

receive second data from the mobile device via the second communication link in response to the mobile device being disconnected from the vehicle, wherein the mobile device is communicatively coupled with the vehicle via a third communication link different from the first communication link and the second communication link, and the second data includes updated first data received from the vehicle via the third communication link;

upon failing to receive the updated first data from the vehicle via the first communication link at a next scheduled interval of the periodic intervals, determine whether the vehicle was in motion or stationary at a time of a disconnect between the vehicle and the mobile device based on the second data received from the mobile device;

in response to determining that the vehicle was in motion at the time of the disconnect, estimating a remaining travel time based on the second data to estimate the end of the vehicle trip;

in response to determining that the vehicle was stationary at the time of the disconnect, estimating the end of the vehicle trip as the time of the disconnect; and generate a trip log with the estimated end of the vehicle trip.

2. The system of claim 1, wherein the processor is further configured to store the estimated end of the vehicle trip until the first data is received from the vehicle upon starting the vehicle.

3. The system of claim 2, wherein the processor is further configured to:

replace the estimated end of the vehicle trip with an actual end time for the vehicle trip based on the first data received from the vehicle upon starting the vehicle; and generate an updated trip log indicating the actual end time.

4. The system of claim 1, wherein the third communication link between the mobile device and the vehicle is monitored by an application operating on at least one of the mobile device and the vehicle.

5. The system of claim 1, wherein the first data comprises floating car data.

6. A method for estimating an end of a vehicle trip of a vehicle, comprising:

receiving, by a system communicatively coupled with the vehicle via a first communication link, first data from the vehicle, the first data being received from the vehicle at a first scheduled interval of periodic intervals;

receiving, by the system communicatively coupled with a mobile device via a second communication link different from the first communication link, second data from the mobile device in response to the mobile device being disconnected from the vehicle, wherein the mobile device is communicatively coupled with the vehicle via a third communication link different from the first communication link and the second communication link, and the second data includes updated first data received from the vehicle via the third communication link;

upon failing to receive the updated first data from the vehicle via the first communication link at a next scheduled interval of the periodic intervals, determining, by the system, whether the vehicle was in motion or stationary at a time of a disconnect between the vehicle and the mobile device based on the second data received from the mobile device;

in response to determining that the vehicle was in motion at the time of the disconnect, estimating, by the system, a remaining travel time based on the second data to estimate the end of the vehicle trip;

in response to determining that the vehicle was stationary at the time of the disconnect, estimating, by the system, the end of the vehicle trip as the time of the disconnect; and generating, by the system, a trip log with the estimated end of the vehicle trip.

7. The method of claim 6, further comprising storing the estimated end of the vehicle trip until the first data is received from the vehicle upon starting the vehicle.

8. The method of claim 7, further comprising:

replacing the estimated end of the vehicle trip with an actual end time for the vehicle trip based on the first data received from the vehicle upon starting the vehicle; and generating an updated trip log indicating the actual end time.

9. The method of claim 6, wherein the third communication link between the mobile device and the vehicle is monitored by an application operating on at least one of the mobile device and the vehicle.

10. The method of claim 6, wherein the first data comprises floating car data.

11. A non-transitory computer-readable storage medium containing executable computer program code for estimating an end of a vehicle trip of a vehicle, the code comprising instructions configured to cause a processor of a system communicatively coupled with a vehicle via a first communication link and a mobile device via a second communication link different from the first communication link to:

receive first data from the vehicle via the first communication link, the first data being received from the vehicle at a first scheduled interval of periodic intervals;

receive second data from the mobile device via the second communication link in response to the mobile device being disconnected from the vehicle, wherein the mobile device is communicatively coupled with the vehicle via a third communication link different from the first communication link and the second communication link, and the second data includes updated first data received from the vehicle via the third communication link;

upon failing to receive the updated first data from the vehicle via the first communication link at a next scheduled interval of the periodic intervals, determine whether the vehicle was in motion or stationary at a time of a disconnect between the vehicle and the mobile device based on the second data received from the mobile device;

in response to determining that the vehicle was in motion at the time of the disconnect, estimating a remaining travel time based on the second data to estimate the end of the vehicle trip;

in response to determining that the vehicle was stationary at the time of the disconnect, estimating the end of the vehicle trip as the time of the disconnect; and generate a trip log with the estimated end of the vehicle trip.

12. The medium of claim 11, wherein the code further comprises instructions configured to cause the processor to store the estimated end of the vehicle trip until the first data is received from the vehicle upon starting the vehicle.

13. The medium of claim 12, wherein the code further comprises instructions configured to cause the processor to:

replace the estimated end of the vehicle trip with an actual end time for the vehicle trip based on the first data received from the vehicle upon starting the vehicle; and generate an updated trip log indicating the actual end time.

14. The medium of claim 11, wherein the third communication link between the mobile device and the vehicle is monitored by an application operating on at least one of the mobile device and the vehicle.

* * * * *